US006347822B1

(12) United States Patent
Miller, Jr.

(10) Patent No.: US 6,347,822 B1
(45) Date of Patent: Feb. 19, 2002

(54) PLASTIC BAG HOLDER

(76) Inventor: Hal J. Miller, Jr., 37510 Jefferson, Apt. 303, Harrison Township, MI (US) 48045

( * ) Notice: Subject to any disclaimer, the term of this patent is extended or adjusted under 35 U.S.C. 154(b) by 0 days.

(21) Appl. No.: 09/620,806

(22) Filed: Jul. 21, 2000

(51) Int. Cl.[7] ..... B65D 33/06

(52) U.S. Cl. ..... 294/158; 294/137; 294/166

(58) Field of Search ..... 294/31.2, 137, 294/142, 143, 148–152, 156–159, 162, 163, 165–167, 170, 171; 16/114.1, 406, 422, 425, 428; 383/6, 13, 25, 26, 29

(56) References Cited

U.S. PATENT DOCUMENTS

| | | | | | |
|---|---|---|---|---|---|
| 3,554,417 | A | * | 1/1971 | Yorty | 294/150 X |
| 3,675,834 | A | * | 7/1972 | Peters | 294/150 X |
| 3,692,218 | A | * | 9/1972 | Friedman | 294/165 |
| 3,760,463 | A | * | 9/1973 | Schneider | 294/137 X |
| 3,912,140 | A | * | 10/1975 | Franges | 294/166 |
| 4,772,059 | A | * | 9/1988 | Parry et al. | 294/158 X |
| 5,150,938 | A | * | 9/1992 | Gans | 294/158 X |
| 5,441,323 | A | | 8/1995 | Goddard | |
| 5,487,581 | A | | 1/1996 | Carmo | |
| 5,516,175 | A | | 5/1996 | Christensen | |
| 5,615,921 | A | | 4/1997 | Marley et al. | |
| 5,645,306 | A | | 7/1997 | Kosteniuk | |
| 5,651,575 | A | | 7/1997 | Bystrom et al. | |
| 5,658,029 | A | | 8/1997 | Franko | |
| D386,682 | S | * | 11/1997 | Richardson et al. | D9/434 |
| 5,738,401 | A | | 4/1998 | Fan | |

FOREIGN PATENT DOCUMENTS

| | | | | |
|---|---|---|---|---|
| FR | 2652563 | * | 4/1991 | 294/137 |
| FR | 2659626 | * | 9/1991 | 294/137 |
| FR | 2700751 | * | 7/1994 | 294/158 |

* cited by examiner

*Primary Examiner*—Johnny D. Cherry
(74) *Attorney, Agent, or Firm*—Harness, Dickey & Pierce, PLC

(57) ABSTRACT

The present invention discloses a handle device which allows ease of carrying several bags with loop handles. The present invention allows a user to place the loop handles of bags in the handle device and then lock the device to secure the loop handles within the confines of the handle device.

6 Claims, 2 Drawing Sheets

PLASTIC BAG HOLDER

FIELD OF THE INVENTION

The present invention relates generally to a handle device, and more particularly to a handle device that will hold several small plastic bags commonly used at grocery stores and other convenience markets.

BACKGROUND OF THE INVENTION

It is common for individuals to attempt to transport many articles it one time; often this is accomplished by placing several articles in bags. These bags most often have handles attached to them for ease of transport. However, in many instances an individual will attempt to carry several bags at a time.

One example includes trips to the local grocery store where purchases are placed into plastic bags for the customer to transport home. Though the bags are convenient for carrying several articles, generally more than one bag is necessary to include all purchases made. This necessitates the customer attempting to carry several plastic bags, often weighted down with many items. Attempting to hold these bag in the user's bare hands can be painful and difficult.

It is known in the art to use a holder or handle upon which several bags may be placed. These handles are ergonomically designed so as to allow for ease of use and reduce strain on the user's hand. One type of prior art holders simply provides a space which may contain the bags and which is then grasped by the band. U.S. Pat. No. 5,651,575 discloses such device; however, devices similar to these are not very ergonomic and are bulky and provide little additional comfort. Another method includes attaching a hook to a larger handle such as that disclosed in U.S. Pat. No. 5,645,306. Though these devices provide a slight increase in ease of use, they are limited as to the amount that they can carry and provide little in the way of securing the bags onto the handle. A final device provides a locking mechanism as that disclosed in U.S. Pat. No. 5,441,323. This final locking handle, however, is no longer one continuous piece. Rather, the locking mechanism is a separate ring that is not permanently integrated into the device.

SUMMARY OF THE INVENTION

It is an object of the present invention to provide a device that creates a platform into which bag handles may be securely locked. It is an additional object of the present invention to reduce stress on the user's hands when carrying several bags. Additionally, the present invention provides the device in a unitary construction of a durable medium that is long wearing yet flexible enough to allow a fully integrated interlocking mechanism.

Further area of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
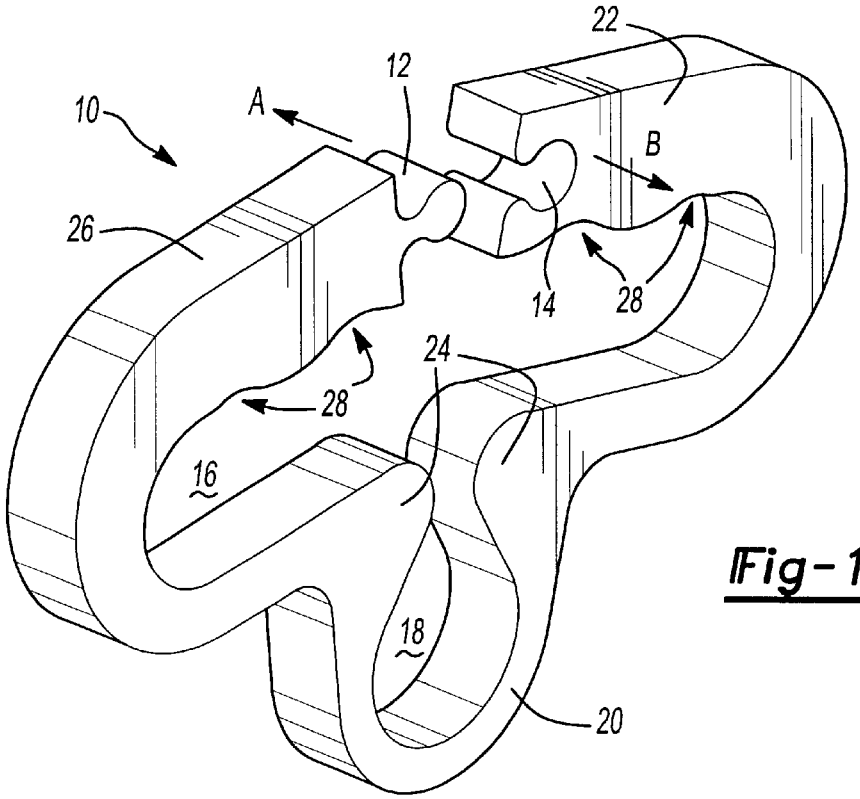
FIG. 1 is a perspective view of the present invention in its unlocked position.

Referring to FIG. 1 the handle device 10 can be seen to be a continuous piece of material with two distinct regions 16 and 18, later described. A first end 26 of the handle device 10, includes a boss 12. A second end 22 of the handle device 10 includes a boss receiving recess 14. The material from which the handle device 10 is manufactured from allows for enough flexibility to enable a user to bias the first end 26 relative to the second end 22. By moving the first end 26 in the direction of arrow A and the second end 22 in the direction of arrow B, the boss 12 may be removed from or moved into the boss receiving recess 14. The design of the handle device 10 and the properties of the material are such that when the handle device 10 is in the unlocked position, a gap between the first end 26 and the second end 22 of the handle device is formed, to insert of remove the loop handles of bags between the first end 26 and the second end 22.

Figure 2:
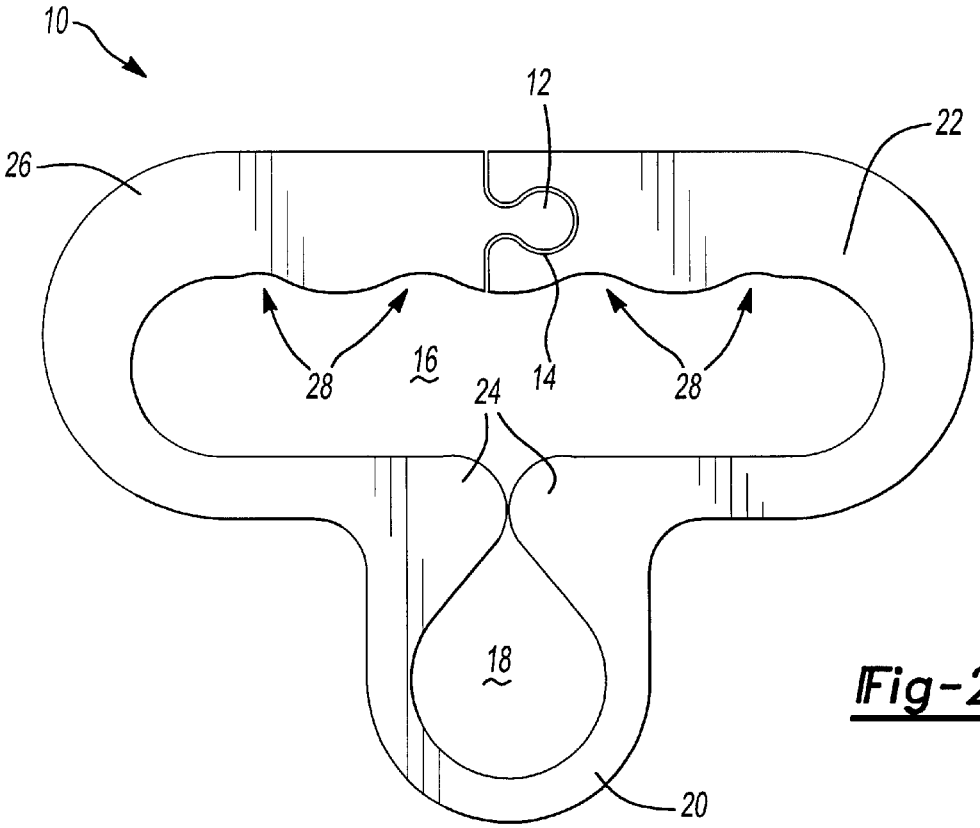
FIG. 2 is a plan view of the present invention in its locked position.
Figure 4:
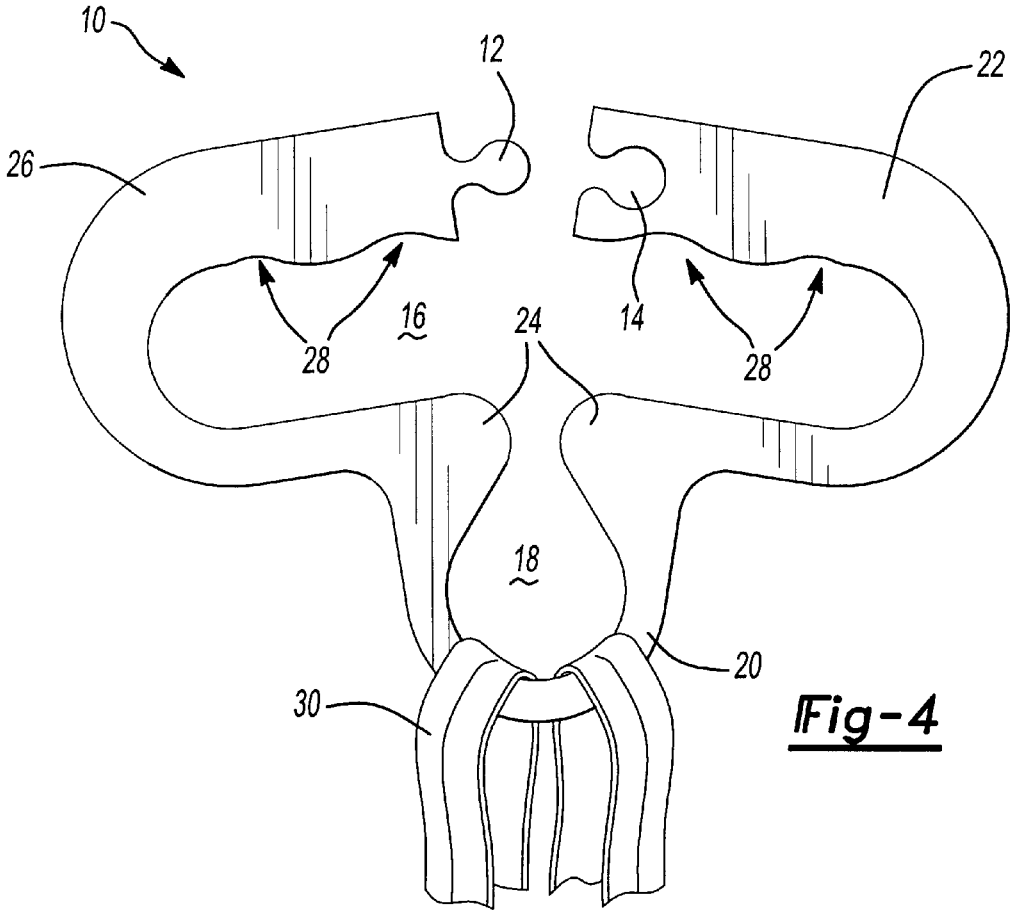
FIG. 4 is a plan view of the present invention in an unlocked position with bags placed in the device.

With continuing reference to FIG. 1 and further reference to FIG. 2, the locked handle device 10 may be described. When the boss 12 is received in the boss receiving recess 14, the handle device is locked. When the handle device 10 is in the locked position, both regions 16 and 18 of the handle device 10 are fully enclosed and more definitely circumscribed. The hand region 16 allows for the user to place his hand in the handle device 10, for carrying articles. Finger indentations 28 are formed in the upper portion of the handle device 10 in the hand region 16, providing additional the comfort during use. Furthermore, the shoulders 24 are also abuttingly engaged when handle device 10 is in the locked position. The shoulders 24, when abutted form the bottom portion of the hand region 16. Loop handles 30, of bags may be placed in the article carrying region 18, as shown in FIG. 4. The boss 12 is then placed within the boss receiving recess 14 thus locking the handle device 10 closed. The article carrying region 18 is also closed.

Figure 3:
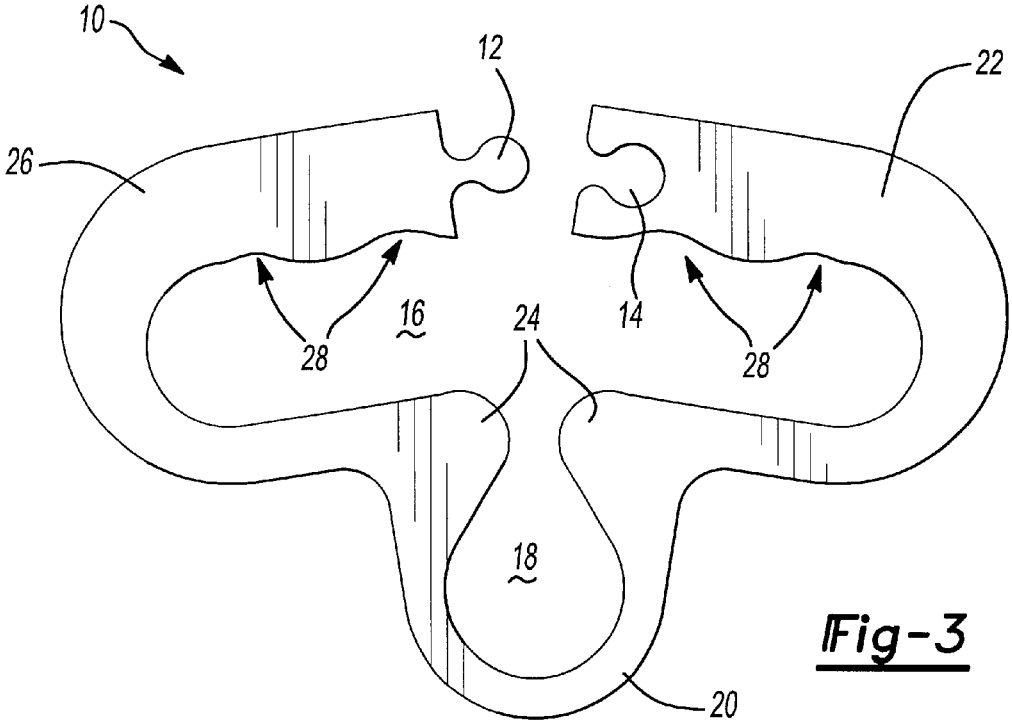
FIG. 3 is a plan view of the present invention in its unlocked position.

Turning reference to FIGS. 1 and 3, the handle device 10 while open may be examined. From the closed position the first end 26 may be moved in the direction of arrow A and the second end 22 may be moved in the direction of arrow B to allow for the handle device 10 to be opened and more particularly directly opening the hand region 16. In doing this, the shoulders 24 are also separated thus opening the article carrying region 18. In the open position, loop handles of bags may be introduced to or removed from the article carrying region 18. Once loop handles 30 are introduced into the article carrying region 18, as seen in FIG. 4, the handle device 10 may then be re-closed, as in FIG. 2, following the reverse procedure outlined above.

As previously mentioned, the device 10 is of a one piece monolithic structure which can be fabricated by well known plastic injection molding technology. If desired, a suitable name, logo, or advertising indicia can be molded directly on the device 10 adjacent the boss 12 and boss receiving recess 14.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A semi-rigid, handle device of monolithic structure for carrying articles comprising:

a single member having a first and second end formed to enclose a hand loop for inserting a hand and a separate article loop for enclosing articles;

said hand loop containing a locking means for changeably interlocking said first and second ends of said member, said locking means being changeable from a locked position to an opened position and back again;

said article loop disposed adjacent to said hand loop; and said hand loop and said article loop being closed when said hand loop is in said locked position, said hand loop and said article loop being open when said hand loop is in said opened position.

2. The handle device of claim 1, wherein when said locking means is in said opened position, article loop handles may be placed through an opening between said first end and second end of said member, and further into the article loop.

3. The handle device of claim 1, wherein when said locking means is in said locked position, said hand loop is fully circumscribed.

4. A device to carry several bags with loop shaped handles comprising:

a semi-rigid monolithic member encompassing a first loop and a separate second loop wherein both loops may be changeably reoriented from an open position to a closed position;

said second loop adapted to receive and contain the loop shaped handles of multiple bags;

said first loop having locking means provided by an integral locking boss on one side of said first loop and a boss receiving recess on the opposite side of said first loop, said boss being adapted to snap into said recess to close said first loop;

said second loop having opposed shoulder portions moveable into abutting engagement with one another concomitantly with said first loop being biased to said closed position to positively prevent the handles of the bags secured within the second loop from moving into the first loop and interfering with the locking means.

5. The device of claim 4, wherein said device is manufactured from a rigid plastic polymer.

6. A method for carrying several articles with straps including the steps of:

providing a handle device having an article strap section and a separate hand section;

unlocking the handle device to open the article strap section and the separate hand section;

placing the straps of the articles within the article strap section of the handle device; and locking the handle device to enclose the handle section and the article strap section to secure the straps in the article strap section.

* * * * *

UNITED STATES PATENT AND TRADEMARK OFFICE

CERTIFICATE OF CORRECTION

PATENT NO. : 6,347,822 B1
DATED : February 19, 2002
INVENTOR(S) : Hal J. Miller, Jr.

It is certified that error appears in the above-identified patent and that said Letters Patent is hereby corrected as shown below:

Column 1,
Line 24, "bag" should be -- bags --

Column 2,
Line 38, delete 2nd occurrence of "the"

Column 4,
Line 17, before "device", insert -- handle --

Signed and Sealed this

Fourth Day of June, 2002

*Attest:*

*Attesting Officer*

JAMES E. ROGAN
*Director of the United States Patent and Trademark Office*